US007150293B2

(12) United States Patent
Jonte

(10) Patent No.: US 7,150,293 B2
(45) Date of Patent: Dec. 19, 2006

(54) MULTI-MODE HANDS FREE AUTOMATIC FAUCET

(75) Inventor: Patrick Jonte, Zionsville, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 440 days.

(21) Appl. No.: 10/755,581

(22) Filed: Jan. 12, 2004

(65) Prior Publication Data

US 2005/0150556 A1 Jul. 14, 2005

(51) Int. Cl.
*F16K 31/02* (2006.01)
*G05D 7/06* (2006.01)

(52) U.S. Cl. ..... 137/613; 137/801; 251/129.04; 4/623

(58) Field of Classification Search ..... 137/613, 137/801, 624.11, 624.12; 251/129.04; 4/623
See application file for complete search history.

(56) References Cited

U.S. PATENT DOCUMENTS 4,709,728 A * 12/1987 Ying-Chung ..... 4/623
5,566,702 A 10/1996 Philipp
6,019,130 A * 2/2000 Rump ..... 251/129.04
6,273,394 B1 8/2001 Vincent
6,363,549 B1 4/2002 Humpert
6,962,168 B1 * 11/2005 McDaniel et al. ..... 137/801

OTHER PUBLICATIONS

TOTO Products, "Commercial Faucets", 2 pages.
ZURN Plumbing Products Group, 07Aquasense Sensor Operated Faucets, 2 pages.
Sloan, Optima i.q. Faucet, 1 page.
Symmons, "Ultra-Sense S-6080", 1 page.
Technical Concepts, AutoFaucet® with "Surround Sensor" Technology, 1 page.

* cited by examiner

*Primary Examiner*—Kevin Lee
(74) *Attorney, Agent, or Firm*—Woodard, Emhardt, Moriarty, McNett & Henry LLP

(57) ABSTRACT

A hands-free faucet comprises a proximity sensor, a logical control, a handle including a first touch control, a second touch control, and a mode indicator. The logical control has a manual mode (wherein the proximity sensor is inactive, and water flow is toggled on and off by positioning the handle) and a hands-free mode (wherein water flow is toggled on and off in response to the proximity sensor). The first touch control puts the faucet in the hands-free mode when touched by a user. The second touch control toggles the logical control between the hands-free mode and the manual mode when touched by a user. The mode indicator indicates which mode the faucet is presently in. The water flow has a temperature and a flow rate that are determined by the position of the handle.

18 Claims, 3 Drawing Sheets

MULTI-MODE HANDS FREE AUTOMATIC FAUCET

BACKGROUND

1. Field of the Invention

The present invention generally relates to the field of automatic faucets. More particularly, the present invention relates to an automatic faucet that uses both proximity and contact sensors in conjunction with logic that responds to various actions to provide easy and intuitive operation.

2. Description of the Related Art

Automatic faucets have become popular for a variety of reasons. They save water, because water can be run only when needed. For example, with a conventional sink faucet, when a user washes their hands the user tends to turn on the water and let it run continuously, rather than turning the water on to wet their hands, turning it off to lather, then turning it back on to rinse. In public bathrooms the ability to shut off the water when the user has departed can both save water and help prevent vandalism.

One early version of an automatic faucet was simply a spring-controlled faucet, which returned to the "off" position either immediately, or shortly after, the handle was released. The former were unsatisfactory because a user could only wash one hand at a time, while the later proved to be mechanically unreliable.

A better solution was hands-free faucets. These faucets employ a proximity detector and an electric power source to activate water flow, and so can be operated without a handle. In addition to helping to conserve water and prevent vandalism, hands-free faucets also had additional advantages, some of which began to make them popular in homes, as well as public bathrooms. For example, there is no need to touch the faucet to activate it; with a conventional faucet, a user with dirty hands may need to wash the faucet after washing their hands. Non-contact operation is also more sanitary, especially in public facilities. Hands-free faucets also provide superior accessibility for the disabled, or for the elderly, or those who need assisted care.

Typically, these faucets use proximity detectors, such as active infrared ("IR") detectors in the form of photodiode pairs, to detect the user's hands (or other objects positioned in the sink for washing). Pulses of IR light are emitted by one diode with the other being used to detect reflections of the emitted light off an object in front of the faucet. Different designs use different locations on the spout for the photodiodes, including placing them at the head of the spout, farther down the spout near its base, or even at positions entirely separate from the spout. Likewise, different designs use different physical mechanisms for detecting the proximity of objects, such as ultrasonic signals or changes in the magnetic permeability near the faucet.

Examples of a hands-free faucets are given in U.S. Pat. No. 5,566,702 to Philippe, and U.S. Pat. No. 6,273,394 to Vincent, and U.S. Pat. No. 6,363,549 to Humpert, which are hereby incorporated herein in their entireties.

Although hands-free faucets have many advantages, depending on how they are used, some tasks may best be accomplished with direct control over the starting and stopping of the flow of water. For example, if the user wishes to fill the basin with water to wash something the hands-free faucet could be frustrating, since it would require the user to keep their hand continuously in the detection zone of the sensors. This is especially likely with a kitchen sink faucet, which may be used in many different tasks, such as washing dishes and utensils. Due to its size, the kitchen sink is often the preferred sink for filling buckets, pots, etc. Thus, there is a need for a kitchen faucet that provides water savings, but which does not interfere with other tasks in which a continuous flow is desired.

Each of these control methods has advantages for a particular intended task. Thus, what is needed is a faucet that provides both conventional, touch control, and hands-free operation modes, so that a user can employ the control mode that is best suited to the task at hand. The present invention is directed towards meeting this need, among others.

SUMMARY OF THE INVENTION

In a first embodiment, the present invention provides a hands-free faucet comprising a proximity sensor, a handle, and a logical control. The logical control comprises a manual mode, wherein the proximity sensor is inactive, and wherein positioning the handle toggles water flow on and off. This logical control also comprises a hands-free mode, wherein water flow is toggled on and off in response to the proximity sensor. The mode-controller toggles the faucet between the hands-free mode and the manual mode. The handle comprises a touch control, the touch control controlling activation of water flow through the faucet in response to contact of a user with the handle that is insufficient to change a position of the handle.

In a second embodiment, the present invention provides a hands-free faucet comprising a proximity sensor and a logical control. The logical control comprises a manual mode, wherein the proximity sensor is inactive, and water flow is toggled on and off by positioning the handle; a hands-free mode, wherein water flow is toggled on and off in response to the proximity sensor; and a handle. The handle comprises a first touch control that puts the faucet in the hands-free mode when touched by a user; a second touch control that toggles the faucet between the hands-free mode and the manual mode when touched by a user; and a mode indicator that displays which mode the faucet is presently in. The water flow has a temperature and flow rate that is determined by the position of the handle.

In a third embodiment, the present invention provides a hands-free kitchen-type faucet.

In a fourth embodiment, the present invention provides a kitchen-type faucet having a touch control that controls activation of water flow through the faucet in response to contact of a user with a handle, where the contact is insufficient to change a position of the handle.

In a fifth embodiment, the present invention provides a hands-free faucet comprising a manual valve; an electrically operable valve in series with the manual valve; and a logical control comprising a manual mode and a hands-free mode, the logical control causing the electrically operable valve to open and close. The faucet enters the manual mode when the faucet detects that water is not flowing through the faucet and the electrically operable valve is open.

In a sixth embodiment, the present invention provides a faucet comprising a pull-down spout, wherein pulling out the pull-down spout activates water flow.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying figures forming a part hereof.

DETAILED DESCRIPTION OF THE PREFERRED EMBODIMENT

For the purposes of promoting an understanding of the principles of the invention, reference will now be made to the preferred embodiment and specific language will be used to describe the same. It will nevertheless be understood that no limitation of the scope of the invention is thereby intended. Such alternations and further modifications in the invention, and such further applications of the principles of the invention as described herein as would normally occur to one skilled in the art to which the invention pertains, are contemplated, and desired to be protected.

A preferred embodiment of the present invention provides a kitchen-type faucet that can be placed in at least two modes, in order to provide water-efficient operation that is easy and convenient to use. In a hands-free mode, the water is activated and deactivated in response to a proximity sensor that detects when something is presently under the spout, so as to provide the most water-efficient operation, while still maintaining easy and convenient operation and use. For other applications, such as filling the sink to wash dishes, or filling pots, bottles, or other such items, the faucet can be operated in manual mode, wherein the water is controlled by a manual handle as with a conventional faucet. When the faucet is manually closed and not in use, the faucet is returned to manual mode, and the proximity detector is deactivated, so that power consumption is limited, making it practical to power the faucet with batteries.

Figure 1:
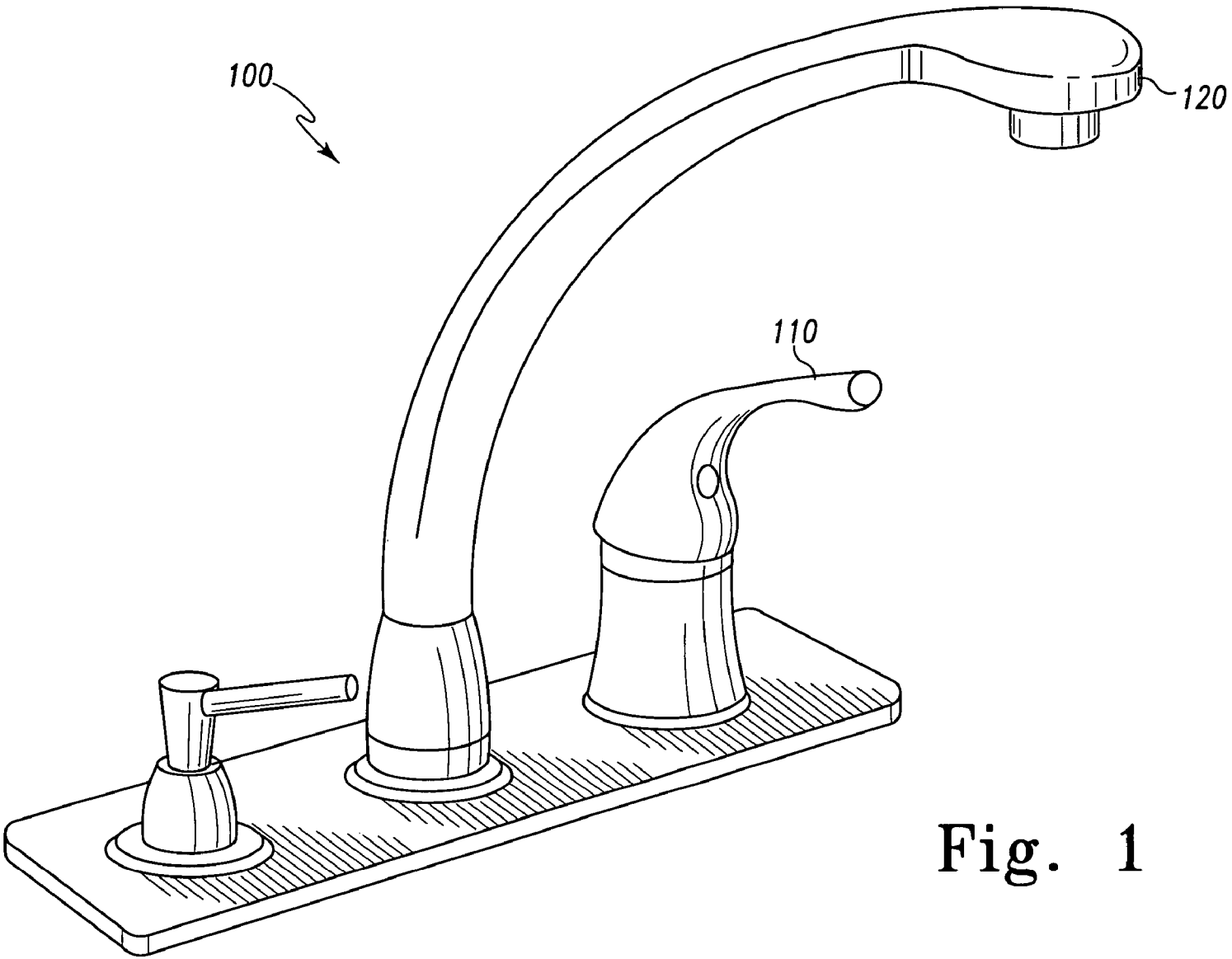
FIG. 1 is a perspective view of a preferred embodiment faucet according to the present invention.

FIG. 1 is a perspective view of a preferred embodiment kitchen-type faucet according to the present invention, indicated generally at 100. The faucet 100 comprises a spout 110, and a swiveling spout 120. It will be appreciated that kitchen-type faucets and lavatory-type faucets are distinguished by a variety of features, such as the size of their spouts, the ability of the spout to swivel, and, often, the manual control. These features are related to the different applications for which they are used. Kitchen-type faucets are generally used for longer periods, and for washing and filling a variety of objects, while lavatory-type faucets are used mostly to wash the user's hands and face. Kitchen-type faucets typically have longer and higher spouts, in order to facilitate placing objects, such as dishes, pots, buckets, etc., under them. Kitchen-type faucets typically rise at least 6 inches above the deck of the sink, and may rise more than a foot. In addition, kitchen-type faucets typically swivel in the horizontal plane, so that they can be directed into either of the pair of basins in a typical kitchen sink. Lavatory-type faucets, on the other hand, are usually fixed, since even bathrooms with more than one sink basin are typically fitted with a separate faucet for each. In addition, kitchen-type faucets are generally controlled by a single manual handle that controls both the hot and cold water supplies, because it makes it easier to operate while one hand is holding something. Lavatory-type faucets more often have separate hot and cold water handles, in part for aesthetic reasons. Although there are exceptions to each of these general rules, in practice kitchen-type faucets and lavatory-type faucets are easily distinguished by users.

While the present invention's multi-mode operation is especially useful for kitchen sinks, the present invention may also be used with a lavatory-type faucet.

A preferred embodiment faucet according to the present invention comprises a manually controlled valve in series with a magnetically latching pilot-controlled solenoid valve. Thus, when the solenoid valve is open the faucet can be operated in a conventional manner, in a manual control mode. Conversely, when the manually controlled valve is set to select a water temperature and flow rate the solenoid valve can be touch controlled, or activated by proximity sensors when an object (such as a user's hands) is within a detection zone to toggle water flow on and off. An advantageous configuration for a proximity detector and logical control for the faucet in response to the proximity detector is described in greater detail in the concurrently filed application entitled "Control Arrangement for an Automatic Residential Faucet," which is hereby incorporated in its entirety.

It will be appreciated that a proximity sensor is any type of device that senses proximity of objects, including, for example, typical infrared or ultrasound sensors known in the art. Touch or contact sensors, in contrast, sense contact of objects.

Magnetically latching solenoids comprise at least one permanent magnet. When the armature is unseated, it is sufficiently distant from the at least one permanent magnet that it applies little force to the armature. However, when a pulse of power is applied to the solenoid coil the armature is moved to the latched position, sufficiently close to the at least one permanent magnet that the armature is held in place. The armature remains seated in the latched position until a pulse of power is applied to the solenoid coil that generates a relatively strong opposing magnetic field, which neutralizes the latching magnetic field and allows a spring to drive the armature back to the unlatched position. Thus, a magnetically latching solenoid, unlike typical solenoids, does not require power to hold the armature in either position, but does require power to actuate the armature in both directions. While the preferred embodiment employs a magnetically latching solenoid valve, it will be appreciated that any suitable electrically operable valve can be used in series with the manual valve. For example, any type of solenoid valve can be used.

Preferably, the electrically operable valve is relatively slow-opening and -closing, in order to reduce pressure spikes, known as "water hammer," and undesirable splashing. On the other hand, the valve should not open or close so slowly as to be irritating to the user. It has been determined that a valve opening or closing period of at least 0.5 seconds sufficiently suppresses water hammer and splashing.

In the preferred embodiment the magnetically latching solenoid is controlled by electronic circuitry that implements logical control of the faucet. This logical control includes at least two functional modes: a manual mode, wherein the electrically operable valve remains open, and a hands-free mode, wherein the electrically operable valve is toggled in response to signals from a proximity sensor. Thus, in the manual mode the faucet is controlled by the position of the handle like a conventional faucet, while in the hands-free mode, the flow is toggled on and off in response to the proximity sensor (while the flow temperature and rate are still controlled by the handle position normally).

In the preferred embodiment, the faucet is set to operate in a hands-free mode by the user, for example by a push-button, by a strain gauge or piezoelectric sensor incorporated into a portion of the faucet, such as the spout, or by a capacitive touch button or other capacitive touch detector. It will be appreciated that a touch control, whether implemented with a strain gauge or a capacitive touch-sensor can respond to contact between a user and the handle that is insufficient to change a position of the handle.

The capacitive touch control may be incorporated into the spout of the faucet, as taught by the concurrently filed patent application entitled "Capacitive Touch Control for an Automatic Residential Faucet," which is hereby incorporated in its entirety. In certain embodiments, the same mode-selector can be used to return the faucet from hands-free mode to manual mode. In certain of these embodiments, a touch-sensor is also incorporated into the handle; in these embodiments, the two touch controls can either operate independently (i.e. mode can be changed by touching either one of the touch controls), or together, so that the mode is changed only when both touch controls are simultaneously touched.

In certain alternative embodiments, once placed in hands-free mode the faucet can be returned to manual mode simply by returning the manual faucet control handle to a closed position. In addition, in certain embodiments the faucet returns to manual mode after some period of time, such as 20 minutes, without user intervention. This time-out feature is useful for applications in which power is supplied by batteries, because it preserves battery life. However, in application in which power is supplied by an AC circuit, this feature is superfluous, and is preferably omitted or deactivated.

Once the hands-free mode is activated the solenoid valve is closed, stopping the water flow. This state is the hands-free standby state, in which water flow will be activated by a proximity detector. The manual valve handle preferably remains in the open position; in any event, the manual valve remains open, so that flow is halted only by the electrically operable valve.

In the hands-free standby state, objects positioned within the sensor's trigger zone cause the faucet to enter the hands-free active state, wherein the electrically operable valve is opened, thus permitting the water to flow. The faucet remains in hands-free active mode, and the electrically operable valve remains open, as long as objects are detected within the sensor's trigger zone. When objects are no longer detected in the sensor's trigger zone, the faucet returns to hands-free standby mode, and the electrically operable valve closes.

It will be appreciated that water flow is important while a user is attempting to adjust the flow rate or temperature; the user observes these properties as they are adjusted, in effect completing a feedback loop. Thus, adjustment of the flow properties is another case in which water flow is preferably activated without requiring the user to place their hands or an object in the trigger zone. Therefore, in the preferred embodiment, when the faucet is in standby hands-free mode the faucet switches to active hands-free mode, and the solenoid is opened, whenever the manual control handle is touched.

In certain alternative embodiments, when the handle is touched while in hands-free mode the faucet switches to manual mode, which will, of course, also result in activating the water flow (unless the handle is closed), as well as the deactivation of the proximity sensor. If the user wishes to then return to hands-free mode they can reactivate it in the usual way, such as by a touch control.

In the preferred embodiment, the faucet does not immediately enter hands-free mode when the manual valve is opened and released. Instead, the faucet enters a "quasi-hands-free" state, in which the faucet continues to be manually controlled, and the electrically operable valve remaining open. This quasi-hands-free state persists as long as the IR sensor does not detect the presence of an object within the active sensing zone. This allows the faucet to function as a normal manual valve when initially operated, but to switch modes to hands-free automatically when sensing the presence of an object within the trigger zone (discussed in greater detail hereinbelow). The advantage of this quasi-hands-free mode is that the faucet can be operated as a convention manual faucet without the inconvenience of having to manually select the manual mode. This is valuable, for example, in single-use activations such as getting a glass of water or when guests use the faucet. In these embodiments, when the user initially opens the faucet and adjusts the water temperature or flow rate and then releases the handle, the water does not immediately shut off, thereby frustrating the user's attempt to operate the faucet as a manual faucet. After the user had adjusted the flow, and places an object within the faucet's detection zone (as described in greater detail hereinbelow), the faucet will then enter hands-free mode.

Because the behavior of the faucet in response to its various input devices is a function of the mode it is presently in, preferably, the faucet includes some type of low-power indicator to identify its current mode. Appropriate indicators include LEDs (light emitting diodes), LCDs (liquid crystal displays), or a magnetically latching mechanical indicator. In certain embodiments, the mode indicator may simply be a single bit indicator (such as a single LED) that is activated when the faucet is in hands-free mode. Alternatively, the mode indicator may include a separate bit display for each possible mode. In still other embodiments, the mode indicator may indicate mode in some other way, such as a multi-color LED, in which one color indicates hands-free mode, and one or more other colors indicate other modes. In addition, transition between modes can be indicated by an audio output.

When a user is finished using the sink it is advantageous that the faucet be powered down and returned to a baseline state. Powering down provides power savings, which makes it feasible to operate the faucet from battery power. Returning the faucet to a baseline state is helpful because it gives predictable behavior when the user first begins using the faucet in a particular period of operation. Preferably, the baseline state is the manual mode, since the next user of the sink might not be familiar with the hands-free operation. It is preferable that a user be able to power down the faucet and return it to the manual, baseline mode simply by returning the manual handle to the closed position, because this is a reflexive and intuitive way for users to do so.

As a consequence, the preferred embodiment faucet can sense whether the handle is in the closed position. It will be appreciated that this can be accomplished directly, via a sensor in the manual valve that detects when the valve is closed, such as by including a small magnet in the handle, and an appropriately positioned Hall effect sensor. Alternatively, the handle position can be observed indirectly, for example by measuring water pressure above and below the manual valve, or with a commercial flow sensor, such as the FS-3 Series manufactured and sold by Gems Sensors. (Gems Sensors can be contacted at 1(800) 378-1600, or via their website at www.gemsensors.com.) However, it will be appreciated that this inference is only valid if the electrically operable valve is open. It will be appreciated that, because the electrically operable valve is controlled electronically, this is easily tracked. Thus, in the preferred embodiment, the faucet is returned to manual mode when both the electrically operable valve is open and water is not flowing through the faucet.

Preferably, the faucet also includes a "watchdog" timer, which automatically closes the electrically operable valve after a certain period of time, in order to prevent flooding. In certain of these embodiments, normal operation is resumed once an object is no longer detected in the sensor's trigger zone. In certain other embodiments, normal operation is resumed once the manual valve is closed. In still other embodiments, normal operation is resumed in either event. In those embodiments including a hands-free mode indicator, the indicator is preferably flashed, or otherwise controlled to indicate the time-out condition.

In addition to the various power-saving measures described above, the preferred embodiment also includes an output mechanism that alerts users when batter power is low. It will be appreciated that any suitable output mechanism may be used, but in the presently preferred embodiment an LED and an audio output are used.

Figure 2A:
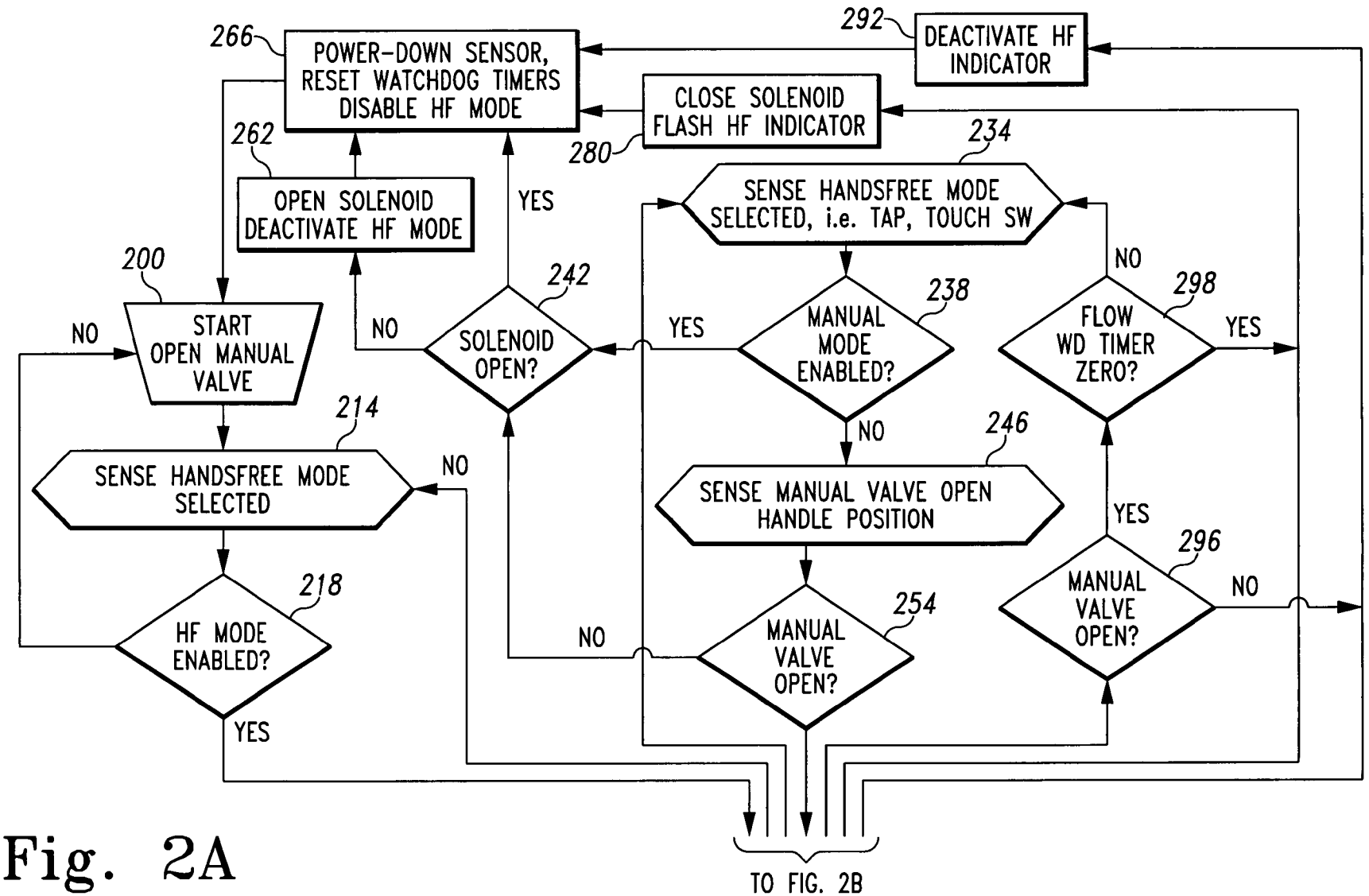
FIG. 2 is a diagram of a logical control for a preferred embodiment faucet according to the present invention.
Figure 2B:
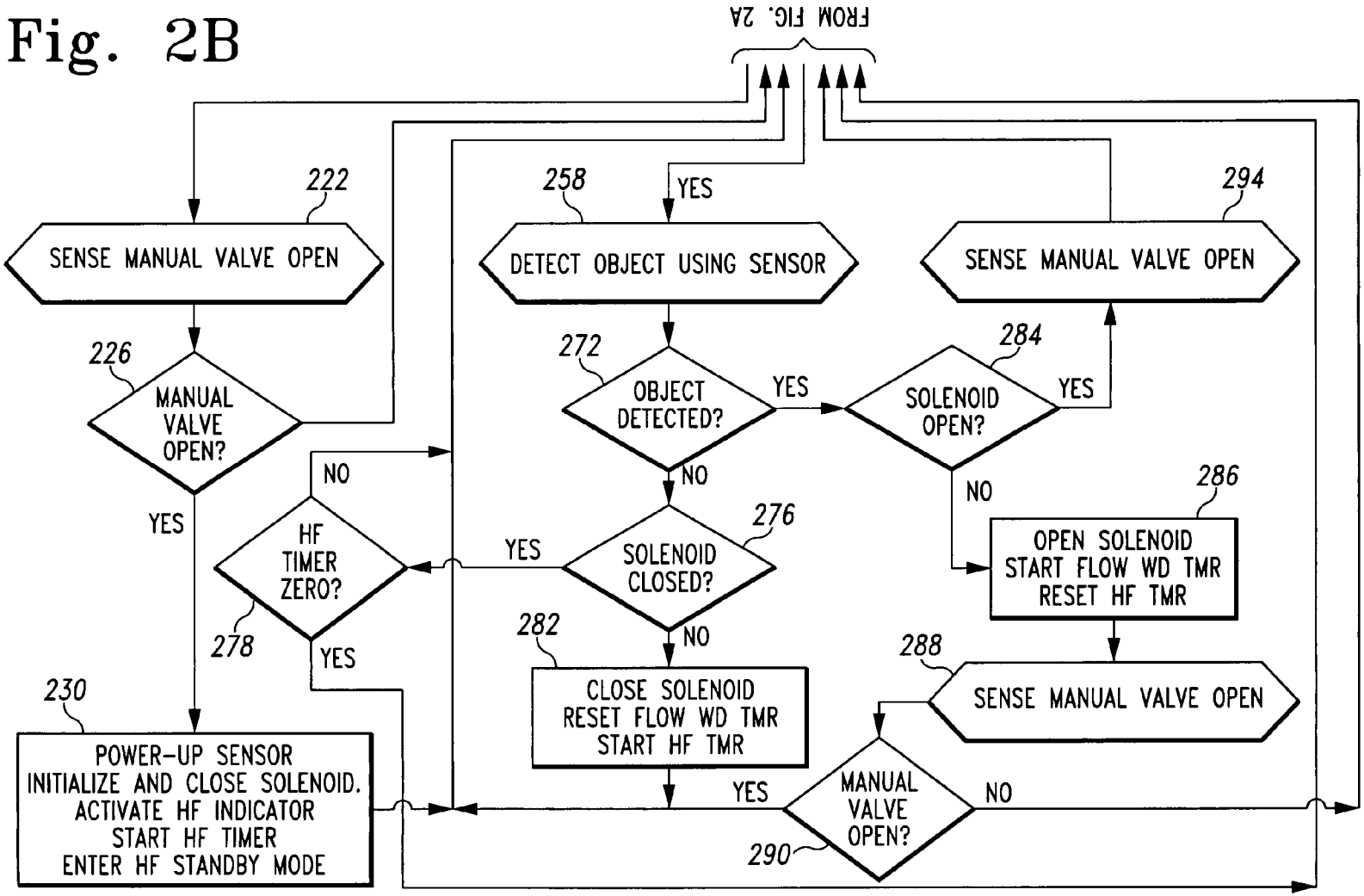

FIGS. 2A and 2B are a flowchart illustrating the logical control for a preferred embodiment faucet according to the present invention. The logical control begins each use session at 200, when the manual handle is used to open the manual valve. At this time, the faucet is in the manual mode (which fact will be displayed by the mode indicator, in those embodiments wherein the mode sensor does not simply activate to indicate hands-free mode). At 214 the mode selectors, including the touch sensor in the spout and the touch-button, are monitored for instructions from the user to enter hands-free mode. At 218 it is determined whether the hands-free mode has been enabled. If not, the logical control returns to 200. If at 218 it is determined that the hands-free mode has been enabled, at 222 the flow sensor is monitored to determine whether the manual valve is open. At 226 it is determined whether the manual valve is open. If not, the logical control returns to 214. If at 226 it is determined that the manual valve is open, hands-free mode is activated at 230.

At 230, hands-free mode is activated by powering up the proximity sensor, initializing and closing the electrically operable valve (thereby shutting off water flow), activating the mode indicator to display hands-free mode, and initializing the hands-free timer. At this time, the faucet is in hands-free standby mode.

At 234 the mode selectors are monitored for instructions to return to manual mode. At 238, it is determined whether manual mode has been enabled. If so, at 242 it is determined whether the electrically operable valve is open. If at 238 it is determined that manual mode has not been enabled, at 246 the manual handle position is sensed, and at 254 it is determined whether the manual valve is open. If not, at 242 it is determined whether the electrically operable valve is open.

If at 242 it is determined that the electrically operable valve is closed (a "No" result), at 262 the solenoid is opened, and the mode indicator is set to no longer display hands-free mode. If at 242 it is determined that the electrically operable valve is open, or after it is opened at 262, then at 266 the proximity sensor is powered down and the hands-free and watchdog timers are reset. At this time the faucet is in manual mode, and the logical control returns to 200.

If at 254 it is determined that the manual valve is open, then at 258 the proximity sensor is monitored. At 272 it is determined whether the proximity detector has detected an object that should activate water flow. If not, at 276 it is determined whether the solenoid is closed. If at 276 it is determined that the solenoid is closed, at 278 it is determined whether the hands-free timer has expired. If at 278 the hands-free timer has not expired, the logical control returns to 234; otherwise it proceeds to 280, where the solenoid is closed, and the mode indicator is activated to indicate the timeout condition, after which the logical control passes to 266. If at 276 it is determined that the solenoid is not closed, then at 282 the solenoid is closed, the watchdog timer is reset, and the hands-free timer is started, and the logical control then returns to 234.

If at 272 it is determined that an object has been detected which requires that water flow be started, then at 284 it is determined whether the electrically operable valve is open. If not, at 286 the solenoid is opened, the watchdog timer is started, and the hands-free timer is restarted. Then, at 288 the manual valve status is sensed. At 290 it is determined whether the manual valve is open. If so, the logical control returns to 234. Otherwise, at 292 the mode indicator is activated to indicate that the faucet is no longer in hands-free mode, and the logical control then passes to 266.

If at 284 it is determined that the electrically operable valve is open, then at 294 the manual valve status is sensed. At 296 it is determined whether the manual valve is open. If not, the logical control proceeds to 292. If at 296 it is determined that the manual valve is open, then at 298 it is determined whether the watchdog timer has expired. If not, the logical control returns to 234, but if so, the logical control proceeds to 280.

In the preferred embodiment the spout of the faucet is a "pull-down" spout. Those skilled in the art will appreciate that a pull-down spout is a spout that includes an extendible hose that connects it to the valve assembly, thereby permitting the spout to be pulled out from its rest position, where it can be used similarly to a garden hose, to direct water as the user wishes. In the preferred embodiment, when the pull-down spout is extended the faucet the electrically operable valve is automatically opened, so that water flow is controlled by the manual handle. In certain embodiments, this is effected by returning the faucet to manual mode. In certain other embodiments, though, when the spout is retracted the faucet resumes hands-free operation (assuming it was in hands-free mode when the spout was extended). Thus, in these embodiments, when the spout is extended the faucet effectively enters another mode. Note that this mode need not be distinguished from the hands-free mode by the mode indicator, though, since its presence will be obvious and intuitively understood because of the extended spout. Preferably, the electrically operable valve can be toggled by the tap control during this extended-spout mode.

In the preferred embodiment, the automatic faucet detects that the pull-down spout has been pulled down using Hall-Effect sensors. However, it will be appreciated that any suitable means of detecting that the pull-down spout has been extended may be used.

While the invention has been illustrated and described in detail in the drawings and foregoing description, the description is to be considered as illustrative and not restrictive in character. Only the preferred embodiments, and such alternative embodiments deemed helpful in further illuminating the preferred embodiment, have been shown and described. It will be appreciated that changes and modifications to the forgoing can be made without departing from the scope of the following claims.

What is claimed is:

1. A hands-free faucet comprising:

a handle comprising at least one touch control;

a proximity sensor having an active state and an inactive state;

a logical control, having:

a manual mode, wherein the proximity sensor is inactive, and wherein positioning the handle toggles water flow on and off;

a hands-free mode, wherein water flow is toggled on and off in response to changes in the state of the proximity sensor; and a mode-controller that toggles the faucet between the hands-free mode and the manual mode;

wherein said at least one touch control controls activation of water flow through the faucet in response to contact with the handle that is insufficient to change a position of the handle.

2. The hands-free faucet of claim 1, wherein said at least one touch control activates water flow when the handle is touched.

3. The hands-free faucet of claim 1, wherein said at least one touch control deactivates water flow when the handle is released.

4. The hands-free faucet of claim 3, wherein said at least one touch control deactivates water flow when the handle is released following a time delay.

5. The hands-free faucet of claim 2, wherein the water flow has a temperature and a flow rate that are determined by the position of the handle.

6. The hands-free faucet of claim 1, wherein the handle includes the mode-controller, and touching the handle activates the hands-free mode.

7. The hands-free faucet of claim 6, further comprising a second mode-controller that toggles the faucet between the hands-free mode and the manual mode.

8. The hands-free faucet of claim 1, wherein the faucet is configured as a kitchen-type faucet.

9. The hands-free faucet of claim 1, wherein contacting said at least one touch control toggles water flow through the faucet.

10. The hands-free faucet of claim 1 wherein said handle further comprising a second touch control.

11. The hands-free faucet of claim 10 wherein said second touch control is constructed and arranged to toggle the faucet between the hands-free mode and the manual mode when touched by a user.

12. The hands-free faucet of claim 11 which further includes a mode indicator that indicates which of the manual mode and the hands-free mode the faucet is presently in.

13. The hands-free faucet of claim 1 which further includes a mode indicator that indicates which of the manual mode and the hands-free mode the faucet is presently in.

14. The hands-free faucet of claim 1 which further includes a flow detector for detecting whether or not water is flowing through the faucet.

15. A faucet comprising:

a manual valve;

a pull-down spout;

a proximity sensor having a detection zone, the proximity sensor generating a proximity signal when the proximity sensor senses the presence of an object within the detection zone; and an electrically operable valve in series with the manual valve, the electrically operable valve toggling based on the proximity signal.

16. The faucet of claim 15, further comprising:

a touch control that generates a touch signal; and wherein the electrically operable valve toggles based on the touch signal.

17. The faucet of claim 15, further comprising:

a touch control, comprising:

a touch sensor; and a logical control that generates a touch signal when the touch sensor is touched and released within a period of time less than a predetermined threshold, but which does not generate the touch signal when the touch sensor is touched for a period longer than the predetermined threshold; and wherein the electrically operable valve toggles based on the touch signal.

18. The faucet of claim 17, further comprising:

a proximity sensor having a detection zone, the proximity sensor generating a proximity signal when the proximity sensor senses the presence of an object within the detection zone; and wherein the electrically operable valve toggles based on the proximity signal.

* * * * *